US008757671B2

(12) United States Patent
Pallini, Jr. et al.

(10) Patent No.: US 8,757,671 B2
(45) Date of Patent: Jun. 24, 2014

(54) SLIDE ACTUATING TUBULAR CONNECTOR

(75) Inventors: Joseph William Pallini, Jr., Tomball, TX (US); Steven Matthew Wong, Houston, TX (US); Rockford Dee Lyle, Pinehurst, TX (US)

(73) Assignee: Vetco Gray Inc., Houston, TX (US)

( * ) Notice: Subject to any disclaimer, the term of this patent is extended or adjusted under 35 U.S.C. 154(b) by 90 days.

(21) Appl. No.: 13/310,206

(22) Filed: Dec. 2, 2011

(65) Prior Publication Data

US 2013/0140813 A1 Jun. 6, 2013

(51) Int. Cl.
*F16L 21/06* (2006.01)

(52) U.S. Cl.
USPC ..... 285/322; 285/35

(58) Field of Classification Search
USPC ..... 285/33, 34, 35, 39, 322, 325, 922
See application file for complete search history.

(56) References Cited

U.S. PATENT DOCUMENTS

| | | | | | |
|---|---|---|---|---|---|
| 2,675,829 | A * | 4/1954 | Livers | 137/614.06 |
| 2,784,987 | A * | 3/1957 | Corcoran | 285/82 |
| 3,071,188 | A * | 1/1963 | Raulins | 285/23 |
| 3,224,800 | A * | 12/1965 | Fisher | 403/118 |
| 3,394,950 | A * | 7/1968 | Jensen | 285/35 |
| 3,842,914 | A * | 10/1974 | Mott | 166/377 |
| 4,364,587 | A * | 12/1982 | Samford | 285/3 |
| 4,373,753 | A * | 2/1983 | Ayers et al. | 285/319 |
| 4,693,497 | A | 9/1987 | Pettus et al. | |
| 4,844,510 | A * | 7/1989 | Theiss et al. | 285/18 |
| 4,902,045 | A * | 2/1990 | McGugan et al. | 285/24 |
| 4,903,992 | A | 2/1990 | Jennings et al. | |
| 5,427,488 | A * | 6/1995 | Fullerton et al. | 411/433 |
| 5,685,574 | A * | 11/1997 | Kohli et al. | 285/35 |
| 5,879,030 | A | 3/1999 | Clayson et al. | |
| 7,686,087 | B2 * | 3/2010 | Pallini et al. | 166/367 |
| 7,857,361 | B1 * | 12/2010 | Hanser et al. | 285/322 |
| 8,210,264 | B2 * | 7/2012 | Mohr | 166/343 |
| 8,312,933 | B2 * | 11/2012 | Larson et al. | 166/380 |
| 2005/0001427 | A1 * | 1/2005 | Liew | 285/322 |
| 2007/0252387 | A1 | 11/2007 | Beard et al. | |
| 2008/0111375 | A1 | 5/2008 | Bilderbeek | |

OTHER PUBLICATIONS

Search Report from corresponding GB Application No. GB1221219.7 dated Feb. 14, 2013.

* cited by examiner

*Primary Examiner* — Aaron Dunwoody
(74) *Attorney, Agent, or Firm* — Bracewell & Giuliani LLP

(57) ABSTRACT

A subsea riser assembly connects two tubular members with axial movement of an outer sleeve. The assembly includes a first tubular member having an end, and a second tubular member having an end with a plurality of box end fingers separated by slots, the second tubular member coaxial with the first tubular member. The end of the first tubular member is inserted into the end of the second tubular member. An outer sleeve having an inner diameter that engages an outer diameter of each box end finger. Axial movement of the outer sleeve relative to the box end fingers causes the inner diameter of the outer sleeve to interact with the outer diameter of the box end fingers, thereby causing the box end fingers to contract radially. The radial contraction of the box end fingers secures the first tubular member to the second tubular member in a made-up position.

22 Claims, 4 Drawing Sheets

SLIDE ACTUATING TUBULAR CONNECTOR

BACKGROUND OF THE INVENTION

1. Field of the Invention

This invention relates in general to drilling and production of oil and gas wells and, in particular, to a design of a slide actuating connector for tubular members.

2. Brief Description of Related Art

A riser is a large diameter pipe used in offshore drilling, production, export, import, mining, and free standing operations to guide the tubing strings, such as drill strings or production strings, from the offshore platform to and from the subsea wellhead and to provide means for circulation of fluid. The tubing string is lowered through the riser. Fluid circulates down from the platform through the tubing string, out through the drill bit, or other sub assembly, and returns to the platform in the space between the inner diameter of the riser and the outer diameter of the tubing string. Environmental forces caused by waves, currents, and the movement of the offshore platform, as well as internal forces caused by the weight of the heavy fluids, all contribute to the substantial loads applied to the riser. Additionally, high pressure risers, utilizing surface blowout preventers, may be exposed to full wellbore pressure. The connection between each successive joint of the riser must be able to withstand such loads.

The prior art makes up the riser pipe or joint connections with bolted flange type connectors or with radially oriented screws that move dogs into and out of engagement with a profile on the riser pipe. Both of these methods require manipulation with a wrench or stud tensioning device, placing personnel in close proximity to the drilling slots for prolonged periods of time, and increasing the danger level of performing the task.

In another prior art embodiment the riser box ends are formed with pockets and locking members positioned within the pockets. The locking members have a profile that mates with a profile on a pin end of the adjacent riser. This riser assembly includes a special cam ring that is actuated by specialty equipment on the platform. The specialty equipment causes the cam to move the locking members into engagement with the profile of the pin end to secure the riser tubulars. These cam assemblies may significantly increase the cost of the platform due to the increased capital costs for the special equipment and more expensive riser members. Therefore, a riser joint that allows for a strong connection that can be rapidly made-up without placing personnel in close proximity to the drilling slots for prolonged periods of time and at a lower capital cost would be desirable.

In still another prior art embodiment, the riser ends are formed with grooves. A collet, or split ring may surround the riser ends, and a sleeve may surround the collet or split ring. The sleeve will have a specially formed thread on an inner diameter that engages with a mating thread on an outer diameter of the collet or split ring. Rotation of the sleeve relative to the collet or split ring radially contracts the collet or split ring to couple the riser ends together. In embodiments utilizing a collet, the collet has inner diameter grooves that will engage the grooves formed on the riser ends. In embodiments utilizing a split ring, the radial contraction of the split ring will cause the grooves on the riser ends to engage. In these embodiments, one riser end will have grooves on an outer diameter portion, and one riser end will have grooves on an inner diameter portion. These riser assemblies require significant manufacturing time to machine complex collet or split ring engaging components. In addition, the strength of the riser may be limited by the strength of the collet member, a member typically formed with a thinner sidewall and subjected to higher rates of fatigue failure. Still further, make-up of these connectors still require worker proximity to rotating machinery. This is a significant worker injury risk. Therefore, a riser joint that allows for a strong connection not limited by an interposed component that can be rapidly made up without complex machined components is desirable.

SUMMARY OF THE INVENTION

These and other problems are generally solved or circumvented, and technical advantages are generally achieved, by preferred embodiments of the present invention that provide a cost effective rapid make-up connector for tubular members.

In accordance with an embodiment of the present invention, a tubular connector is disclosed. The tubular connector includes a first tubular member having an axis and an end portion with grooves formed on an outer diameter of the end portion. The tubular connector also includes a second tubular member having an end portion with a plurality of box end fingers separated by slots and grooves formed on an inner surface of the box end fingers, the second tubular member being coaxial with the first tubular member. The grooves of the first tubular member are proximate to the grooves of the second tubular member when the first tubular member is inserted into the end of the second tubular member in an initial position. The tubular connector further includes an outer sleeve disposed around the box end fingers. Axial movement of the outer sleeve relative to the box end fingers causes an inner surface of the outer sleeve to slide against the outer surface of the box end fingers, causing the box end fingers to contract radially into engagement with the grooves on the end portion of the second tubular member, thereby securing the first tubular member to the second tubular member in a made-up position.

In accordance with another embodiment of the present invention, a tubular connector is disclosed. The tubular connector includes a first tubular member having an axis and an end portion with grooves formed on an outer diameter of the end portion. The tubular connector also includes a second tubular member having an end portion with a plurality of outwardly biased box end fingers separated by slots, grooves formed on an inner surface of the box end fingers, and an arcuate surface on an outer surface of the box end fingers, the second tubular member being coaxial with the first tubular member. A depth of the second tubular member grooves increases as the grooves approach the second tubular member end portion, and a depth of the first tubular member grooves decreases as the grooves approach the first tubular member end portion. The grooves of the first tubular member are proximate to the grooves of the second tubular member when the first tubular member is inserted into the end of the second tubular member in an initial position. The tubular connector further includes an outer sleeve disposed around the box end fingers and having a tapered inner surface. Axial movement of the outer sleeve relative to the box end fingers causes the tapered inner surface of the outer sleeve to slide against the arcuate outer surface of the box end fingers, causing the box end fingers to contract radially into engagement with the grooves on the end portion of the second tubular member, thereby securing the first tubular member to the second tubular member in a made-up position.

In accordance with yet another embodiment of the present invention, a method for joining tubular members is disclosed. The method provides a first tubular member having a pin end, and a second tubular member having with a box end with outwardly biased fingers and an axially moveable sleeve having an inner cam surface. The method inserts the pin end of the first tubular member into the box end of the second tubular member to align oppositely facing grooves on the box end and the pin end in an initial position. The method moves the sleeve on an outer surface of the box end axially toward the first tubular member to move the box end fingers of the box end of the second tubular member inward into engagement with the pin end of the first tubular member to fully engage the opposite facing grooves and secure the first tubular member to the second tubular member.

In accordance with still another embodiment of the present invention, a tubular connector is disclosed. The tubular connector includes a first tubular member having an axis and an end portion with threads formed on an outer diameter of the end portion, and a second tubular member having an end portion with a plurality of box end fingers separated by slots and threads formed on an inner surface of the box end fingers, the second tubular member being coaxial with the first tubular member. The threads of the first tubular member are proximate to the threads of the second tubular member when the first tubular member is inserted into the end of the second tubular member in an initial position. An outer sleeve is disposed around the box end fingers and has an inner surface. Axial movement of the outer sleeve relative to the box end fingers causes the inner surface of the outer sleeve to slide against the outer surface of the box end fingers, causing the box end fingers to contract radially into engagement with the threads on the end portion of the second tubular member. In this manner the first tubular member secures to the second tubular member in a made-up position.

An advantage of a preferred embodiment is that it provides a cost effective rapid make-up connector for tubular members. The connector may be made-up without a wrench or stud tensioning device, placing personnel in close proximity to the drilling slots for shorter periods of time, and decreasing the danger level of performing the task. In addition, the connector may be made up with no turns, significantly decreasing the time required to make up the connection. Still further, the connection does not require extensive time intensive machining of multiple components to manufacture the riser joint.

BRIEF DESCRIPTION OF THE DRAWINGS

So that the manner in which the features, advantages and objects of the invention, as well as others which will become apparent, are attained, and can be understood in more detail, more particular description of the invention briefly summarized above may be had by reference to the embodiments thereof which are illustrated in the appended drawings that form a part of this specification. It is to be noted, however, that the drawings illustrate only a preferred embodiment of the invention and are therefore not to be considered limiting of its scope as the invention may admit to other equally effective embodiments.

DETAILED DESCRIPTION OF THE PREFERRED EMBODIMENT

The present invention will now be described more fully hereinafter with reference to the accompanying drawings which illustrate embodiments of the invention. This invention may, however, be embodied in many different forms and should not be construed as limited to the illustrated embodiments set forth herein. Rather, these embodiments are provided so that this disclosure will be thorough and complete, and will fully convey the scope of the invention to those skilled in the art. Like numbers refer to like elements throughout.

In the following discussion, numerous specific details are set forth to provide a thorough understanding of the present invention. However, it will be obvious to those skilled in the art that the present invention may be practiced without such specific details. Additionally, for the most part, details concerning rig operation, subsea assembly connections, riser use, and the like have been omitted inasmuch as such details are not considered necessary to obtain a complete understanding of the present invention, and are considered to be within the skills of persons skilled in the relevant art.

Figure 1:
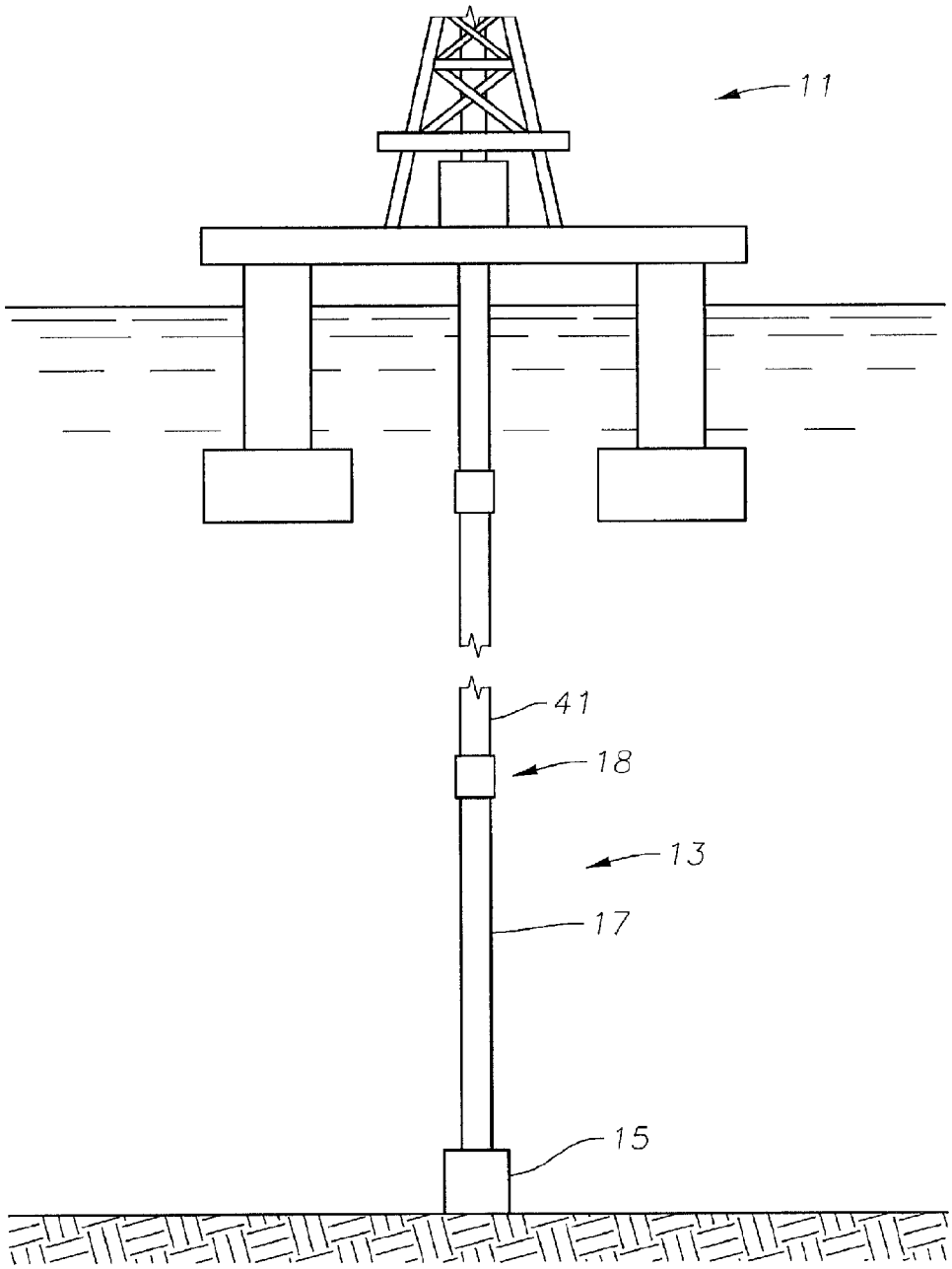
FIG. 1 is a schematic representation of a riser extending between a subsea wellhead assembly and a surface platform.

Described herein are example embodiments of connecting tubulars to form a string of tubulars. Shown in a side view in FIG. 1 is one example of an offshore platform 11 having a riser 13 depending subsea for connection with a subsea wellhead assembly 15 shown on the sea floor. Riser 13 may be formed of a plurality of tubulars, for example a lower tubular 17 and an upper tubular 41, extending several thousand feet between platform 11 and subsea wellhead assembly 15. In the embodiment of FIG. 1, riser 13 is assembled by connecting tubulars 17, 41 at a joint 18 in the manner described in more detail below.

Figure 2:
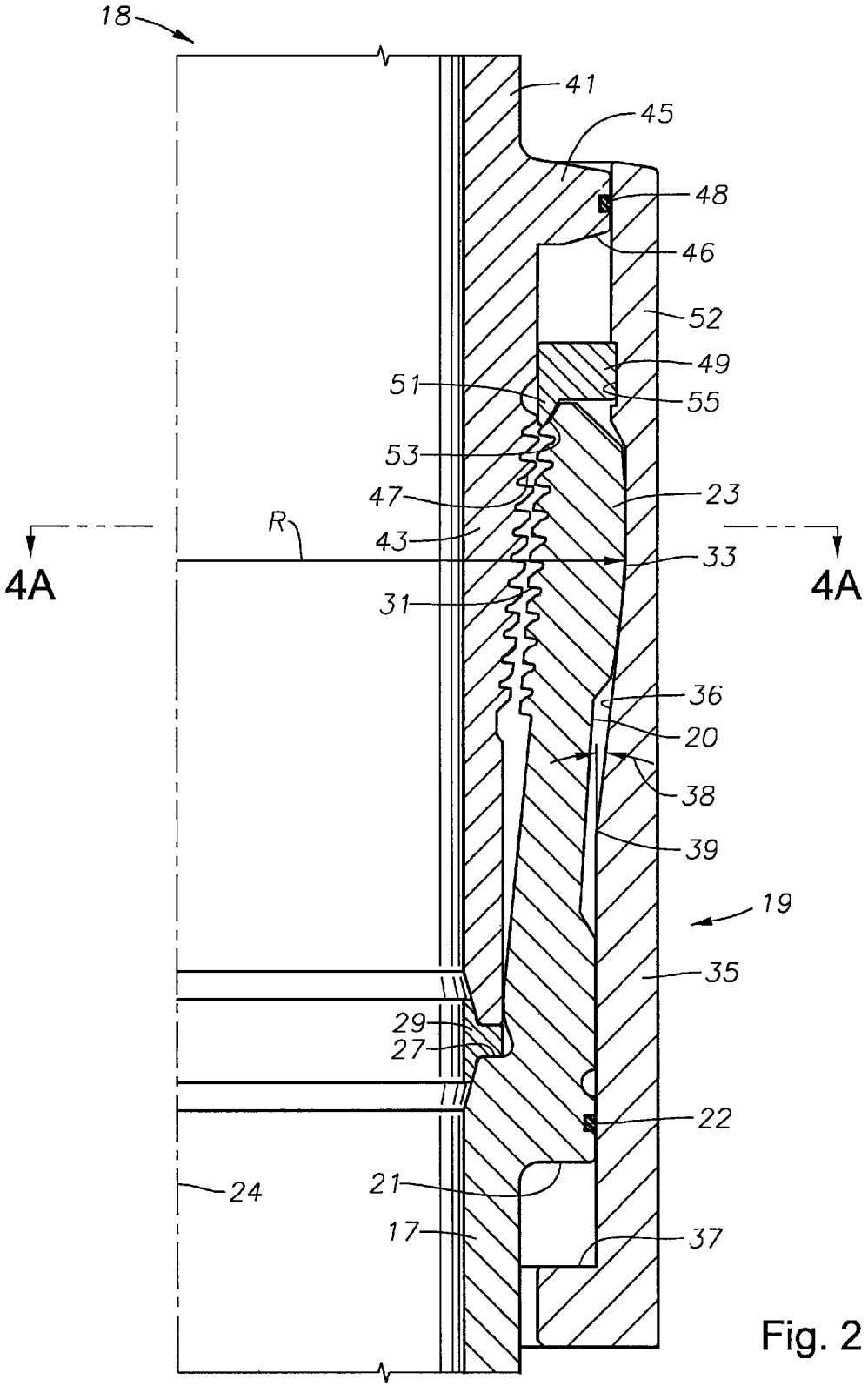
FIGS. 2-3 are side sectional views of a joint for connecting two tubulars of the riser of FIG. 1.
Figure 4A:
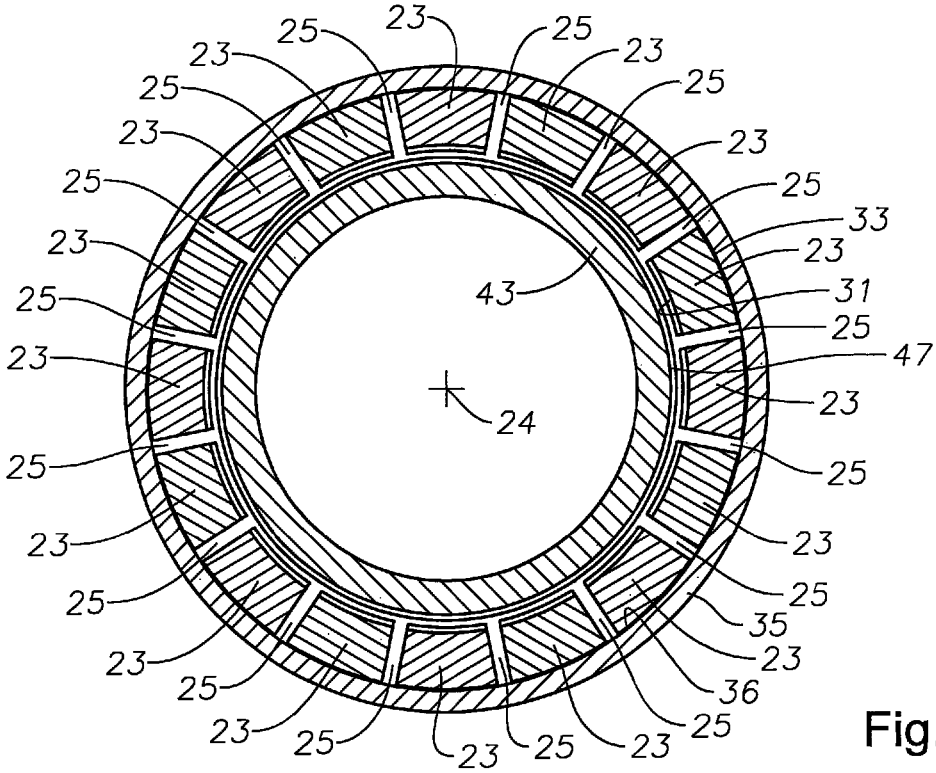
FIG. 4A is a sectional view of the joint of FIG. 2 taken along line 4A-4A.

Referring to FIG. 2, a sectional view of joint 18 in an initial or non-made-up position is shown. A lower tubular 17 has a box end 19 defining a downward facing shoulder 21 on an outer diameter portion of lower tubular 17. As shown in FIG. 4A, box end 19 includes a plurality of box end fingers 23 having slots 25 interposed between each box end finger 23. Slots 25 allow box end fingers 23 to radially contract as described in more detail below. Slots 25 may be formed in any suitable manner, such as by cutting, machining, casting, or the like, and may refer to a cut, channel, aperture, gap, or any other suitable opening to allow for a decrease in the inner diameter of box end 19 at box end fingers 23. In the illustrated there are sixteen box end fingers 23. A person skilled in the art will understand that more or fewer box end fingers 23 may be used. An axis 24 passes through a center of box end 19.

Referring to FIG. 2, box end fingers 23 are axially over downward facing shoulder 21 and are adjacent an upward facing shoulder 27 formed on the inner diameter of lower tubular 17. Box end fingers 23 are biased outward or away from axis 24. In the illustrated embodiment, an optional nose seal 29 is disposed on upward facing shoulder 27. A person skilled in the art will understand that embodiments without nose seal 29 are contemplated and included in the disclosed embodiments. Each box end finger 23 has threads or grooves 31 formed on an inner diameter of box end fingers 23. Grooves 31 extend from an upper end of box end fingers 23 toward upward facing shoulder 27. In the illustrated embodiment, grooves 31 extend only partway toward upward facing shoulder 27. Grooves 31 are formed on a conical surface of box end fingers 23. Grooves 31 may have an increasing depth along the length of box end fingers 23 such that grooves 31 at an end of box end fingers 23 have a greater depth than grooves 31 proximate to upward facing shoulder 27. In the illustrated embodiment, grooves 31 are parallel with each other and have a saw tooth shape. A person skilled in the art will understand that grooves 31 may also comprise threads adapted to engage a mating thread as described in more detail below.

In an initial position, illustrated in FIG. 2, an inner diameter of each box end finger 23 of box end 19 increases from upward facing shoulder 27 to the end of each box end finger 23. An outer surface portion 33 of each box end finger 23 is larger than an outer diameter of box end 19 at downward facing shoulder 21 in the initial position. Outer surface portion 33 extends a length of each box end finger 23 approximately equal to a length of grooves 31 on the inner diameter of each box end finger 23. Outer surface portion 33 may taper or decrease at upper and lower ends of outer surface portion 33. In the illustrated embodiment, outer surface portion 33 is curved and generally convex having a radius R from axis 24. Radius R defines the convex shape of outer surface portion 33. A person skilled in the art will understand that other curvatures, tapers, or angles for outer surface portion 33 may be used. For example, outer surface portion 33 may be a conical surface with an outer diameter that increases from a recess 20 to the end of box end fingers 23. Recess 20 is formed on an outer diameter of box end fingers 23 axially below outer surface portion 33. Recess 20 defines a separation between a cylindrical outer diameter of box end fingers 23 extending axially upwards from downward facing shoulder 21 and outer surface portion 33. Recess 20 also provides a flexible portion of box end fingers 23 that decreases the radial resistance of box end fingers 23 allowing for some radial flex of box end fingers 23 as described in more detail below.

Continuing to refer to FIG. 2, box end 19 also includes an outer diameter sleeve 35. Sleeve 35 includes an annular boss on a lower internal end of the sleeve 35 that defines an upward facing shoulder 37. An inner diameter of sleeve 35 may seal to a lower end of box end 19 proximate to downward facing shoulder 21 with a seal 22. A tapered upper inner diameter 36 of sleeve 35 decreases from a maximum inner diameter near an upper end of sleeve 35 to a minimum inner diameter near upward facing shoulder 37. The wall thickness of sleeve 35 increases in a downward direction. A person skilled in the art will understand that a taper angle 38 formed by tapered inner diameter 36 of sleeve 35 may be any suitable angle such that axial movement of sleeve 35 relative to tubular member 17 may cause sufficient radial deflection of box end fingers 23 as described in more detail below. Taper angle 38 may be formed with an annular surface parallel to axis 24. In an exemplary embodiment, taper angle 38 is between 1° and 30°. In another exemplary embodiment, taper angle 38 is 4°. In the illustrated embodiment, the upper inner diameter 36 extends from a location 39 spaced axially above upward facing shoulder 37 to a location spaced axially below a groove 55, described in more detail below. The inner diameter of sleeve 35 is cylindrical from location 39 to the boss forming upward facing shoulder 37. Upward facing shoulder 37 will not be in contact with downward facing shoulder 21. Inner diameter 36 of sleeve 35 contacts outer surface portion 33 of each box end finger 23.

A person skilled in the art will understand that outer surface portion 33 may be conical as described above. A person skilled in the art will also understand that inner diameter 36 may be conical as illustrated herein, or may have a convex curvature. Embodiments include curved outer surface portion 33 paired with conical inner diameter 36 as shown, conical outer surface portion 33 paired with curved inner diameter 36, curved outer surface portion 33 paired with curved inner diameter 36, and conical outer surface portion 33 paired with conical inner diameter 36. A person skilled in the art will understand that in each embodiment, outer surface portion 33 will interact with inner diameter 36 such that axial movement of the sleeve 35 will cause radial movement of box end fingers 23.

Sleeve 35 may move axially relative to box end 19. Sleeve 35 may be moved axially by any suitable means. In an exemplary embodiment, a hydraulic actuation tool capable of gripping sleeve 35 with sufficient force to prevent slippage of sleeve 35 relative to the hydraulic actuation tool may be used. For example, the hydraulic actuation tool may apply an axial force to sleeve 35 of approximately 500 kips. In another embodiment, sleeve 35 may have grooves, slots, channels, or the like formed in an exterior diameter of sleeve 35. The hydraulic actuation tool may couple or secure to these grooves to apply an axial force to sleeve 35 to actuate joint 18. A person skilled in the art will recognize that any suitable means to actuate joint 18 by moving sleeve 35 is contemplated and included in the disclosed embodiments.

Upper tubular member 41 has a pin end 43 that inserts into box end 19 of lower tubular member 17. In the illustrated embodiment, upper tubular member 41 and lower tubular member 17 are coaxial with axis 24. Pin end 43 has an inner diameter equivalent to the inner diameter of lower tubular member 17 and an outer diameter less than the inner diameter of box end 19. An end of pin end 43 will land on nose seal 29 or, alternatively, upward facing shoulder 27. An annular ring 45 is formed on an outer diameter of pin end 43 and defines a downward facing shoulder 46. Annular ring 45 may be spaced from the end of pin end 43 so that annular ring 45 will be axially over box end fingers 23. In the illustrated embodiment, an upper inner diameter end of sleeve 35 may seal to annular ring 45 with a seal 48. Sleeve 35 has an upper sealing portion 52 proximate to seal 48. Upper sealing portion 52 has a substantially cylindrical inner diameter and an axial length sufficient to allow for sleeve 35 to seal at seal 48 in both the initial position and the made up position. Grooves 47 are formed on an outer diameter portion of pin end 43. As shown in FIG. 4A, grooves 47 are proximate to, but will not engage grooves 31 when pin end 43 is inserted into box end fingers 23 of box end 19 in the initial position. Referring to FIG. 2, Grooves 47 have an increasing thread depth extending from the end of pin end 43 toward annular ring 45 such that grooves 47 may mate with grooves 31. In another embodiment, grooves 47 may comprise threads. A person skilled in the art will recognize that pin end 43 may be inserted into box end 19 so that threads 31, 47 are clocked or aligned so that they may mesh when box end fingers 23 are moved radially into engagement with pin end 43 as described in more detail below.

An unlocking ring 49 may be interposed between pin end 43 and sleeve 35 axially over box end fingers 23. Unlocking ring 49 includes a protrusion 51 with a ramped surface 53 on an inner portion proximate to the outer diameter of pin end 43. Ramped surface 53 may face outward toward sleeve 35. An outer portion of unlocking ring 49 will reside within a groove 55 of sleeve 35. Groove 55 will be axially below upper sealing portion 52. Thus, axial movement of sleeve 35 will result in axial movement of unlocking ring 49. When in the initial position of FIG. 2, protrusion 51 will be interposed between grooves 31 and grooves 47, and unlocking ring 49 will be axially spaced from downward facing shoulder 46.

Figure 3:
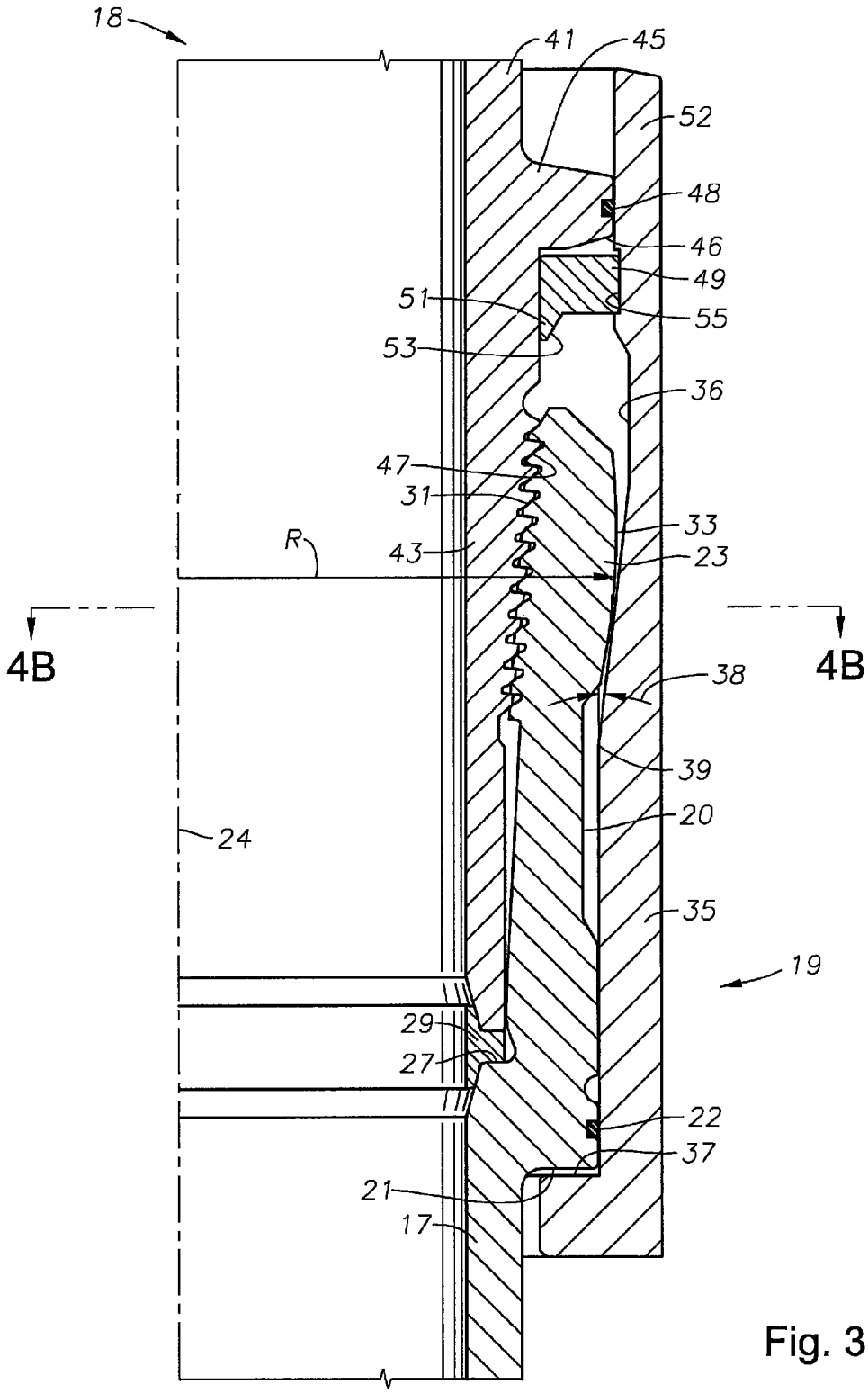
Figure 4B:
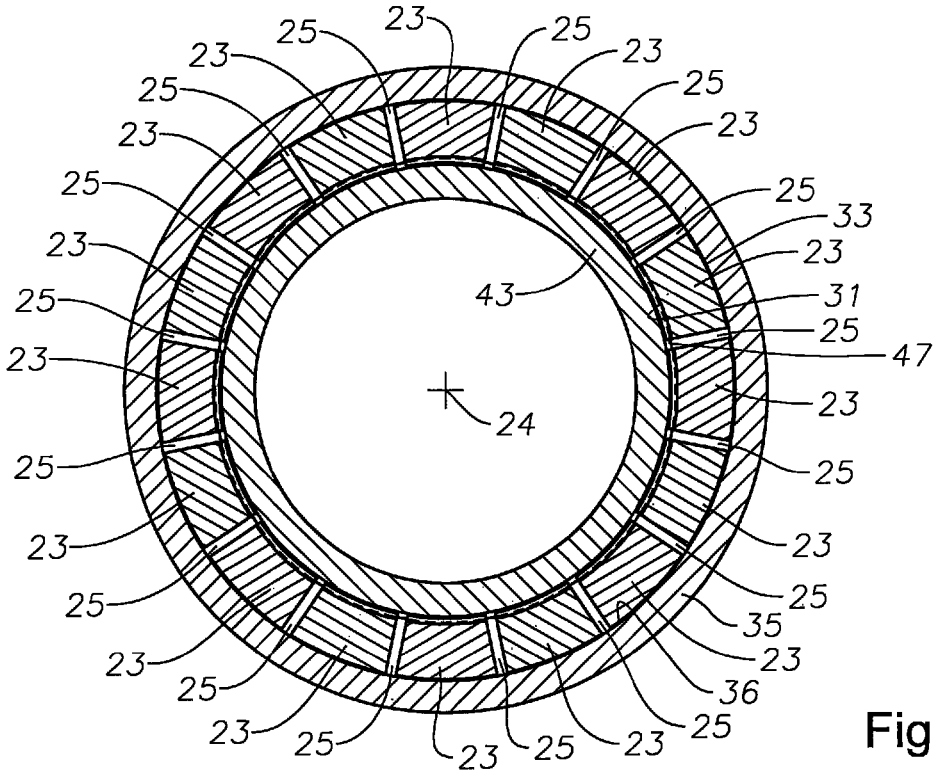
FIG. 4B is a sectional view of the joint of FIG. 3 taken along line 4B-4B.

Referring to FIG. 3, a made-up position of joint 18 is shown. In the illustrated embodiment, sleeve 35 has been moved axially upward relative to lower tubular 17. The axial movement of sleeve 35 relative to lower tubular member 17 will cause tapered inner diameter 36 of sleeve 35 to slide along upper outer surface portion 33, acting as a cam surface. As upper outer surface portion 33 interacts with inner diameter 36, a resulting inward radial force causes box end fingers 23 to contract radially inward to engage grooves 31 to grooves 47, thereby securing lower tubular member 17 to upper tubular member 41. As shown in FIG. 4B, box end fingers 23 flex radially inward so that grooves 47 and grooves 31 engage. Referring to FIG. 3, in an exemplary embodiment, as box end fingers 23 flex radially inward, the angle of contact between outer surface portion 33 and inner diameter portion 36 changes. A person skilled in the art will recognize that tapering or curving ends of outer surface portion 33 allows box end fingers 23 to maintain engagement with inner diameter 36 throughout the axial movement of sleeve 35 and radial contraction of box end fingers 23. A person skilled in the art will recognize that angle or curvature of the ends of outer surface portion 33 may vary depending on the angle of inner diameter 36 of sleeve 35. In addition, box end fingers 23 deflect a greater distance at the ends of box end fingers 23 than where box end fingers 23 join lower tubular member 17 above downward facing shoulder 21. Thus, the increased depth of grooves 31, 47 allow for engagement of grooves 31, 47 along the entire length of grooves 31, 47.

When sleeve 35 moves axially upwards groove 55 may carry unlocking ring 49 axially upwards until the top of unlocking ring 49 is proximate to, but does not contact downward facing shoulder 46. Ramped surface 53 of unlocking ring 49 moves upward relative to box end fingers 23 sufficient to allow grooves 31 to mesh fully with grooves 47. Upwards axial movement of sleeve 35 is limited by interference between inner diameter portion 36 and outer surface portion 33 as inner diameter portion 36 decreases in diameter as it approaches location 39. In the exemplary embodiment, upward facing shoulder 37 will not contact downward facing shoulder 21 when in the made up position of FIG. 3. A person skilled in the art will recognize that in non-made up positions and other alternative embodiments, downward facing shoulder 21 may contact upward facing shoulder 37. When grooves 31 of lower tubular member 17 and grooves 47 of upper tubular member 41 are fully engaged, grooves 31, 47 may cause tubular members 41, 17 to move axially toward each other, ensuring a seal at nose seal 29 between the tubular members 41, 17.

To unlock the tubular members 17, 41, sleeve 35 may move axially in the opposite direction. The downwards axial movement of sleeve 35 will cause protrusion 51 to insert into the mated grooves 31, 47. Continued downwards movement will force protrusion 51 further between grooves 31, 47, releasing grooves 31 of box end fingers 23 from grooves 47 of pin end 43, thereby decoupling lower tubular 17 from upper tubular 41.

As shown in FIG. 3, following upward axial movement of sleeve 35, upper sealing portion 52 will extend beyond annular ring 45. The cylindrical inner diameter of sleeve 35 at upper sealing portion 52 extends a sufficient length to maintain the seal between annular ring 45, seal 48, and sleeve 35.

A person skilled in the art will recognize that following engagement of grooves 31 of tubular member 17 with grooves 47 of tubular member 41, frictional forces between outer surface portion 33 of box end fingers 23 and inner diameter portion 36 of sleeve 35 will maintain engagement of tubular 17 and tubular 41 until sleeve 35 is actively moved to the initial position of FIG. 2. In addition, a back-up device of any suitable means may be used to maintain the axial position of sleeve 35 relative to tubular member 17 as shown in FIG. 3.

A person skilled in the art will understand that while the tubular members are referred to as a lower tubular member and an upper tubular member, it is not necessary that the members be assembled or positioned relative to one another as shown. For example, a first tubular member having pin end 43 may be axially below a second tubular member having box end 19 and the components described above. Joint 18 may then operate generally as described above. A person skilled in the art will recognize that such positioning is contemplated and included in the disclosed embodiments.

Accordingly, the disclosed embodiments provide numerous advantages. For example, the disclosed embodiments provide a cost effective rapid make-up connector for tubular members. The connector may be made-up without a wrench or stud tensioning device, placing personnel in close proximity to the drilling slots for shorter periods of time, and decreasing the danger level of performing the task. Still further, the connection uses a radially collapsible member to generate a higher axial preload force than current tubular connection systems using rotation and torque to make up.

It is understood that the present invention may take many forms and embodiments. Accordingly, several variations may be made in the foregoing without departing from the spirit or scope of the invention. Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered obvious and desirable by those skilled in the art based upon a review of the foregoing description of preferred embodiments. Accordingly, it is appropriate that the appended claims be construed broadly and in a manner consistent with the scope of the invention.

What is claimed is:

1. A tubular connector comprising:

a first tubular member having an axis and an end portion with grooves formed on an outer diameter of the end portion;

a second tubular member having an end portion with a plurality of box end fingers separated by slots and grooves formed on an inner surface of the box end fingers, the second tubular member being coaxial with the first tubular member;

a convex outer surface on an outer side of each of the fingers;

wherein the grooves of the first tubular member are proximate to the grooves of the second tubular member when the first tubular member is inserted into the end of the second tubular member in an initial position;

an outer sleeve disposed around the box end fingers and having an inner surface with an annular recess engaged by the convex arcuate surfaces of the fingers;

an unlocking ring interposed between the first tubular member and the outer sleeve; and wherein axial movement of the outer sleeve relative to the box end fingers causes the recess in the inner surface of the outer sleeve to slide against the convex outer surface of the box end fingers, causing the box end fingers to contract radially into engagement with the grooves on the end portion of the second tubular member, such that the outer sleeve seals against the first tubular member, thereby securing the first tubular member to the second tubular member in a made-up position.

2. The tubular connector of claim 1, wherein:

a depth of the second tubular member grooves gradually increases as the grooves approach the second tubular member end; and a depth of the first tabular member grooves gradually decreases as the grooves approach the first tubular member end.

3. The tabular connector of claim 1, wherein the box end fingers join each other at a cylindrical base of the end portion of the first tubular member;

the box end fingers have a lesser wall thickness area axially between the base and the grooves on the box end fingers to increase flexibility of the box end fingers.

4. The tubular connector of claim 1, further comprising:

a first seal between the end portion of the first tubular member and the outer sleeve:

a second seal between the end portion of the second tubular member and the outer sleeve; and wherein the grooves of the first tubular member, the grooves of the second tubular member, the convex outer surface and the annular recess are located axially between the first and the second seals.

5. The tubular connector of claim 1, wherein the recess has an axial dimension in excess of an axial dimension of the convex outer surfaces on the fingers.

6. The tabular connector of claim 1, further comprising a nose seal interposed between a nose of the end portion of the first tubular member and an internal shoulder in the end portion of the second tubular member.

7. The tubular connector of claim 1, wherein the convex outer surface of the box end fingers is arcuate and has a radius of curvature with a center point located inward of the convex outer surface.

8. The tubular connector of claim 1, wherein the recess in the inner surface of the outer sleeve is has a conical portion joining a cylindrical portion.

9. The tubular connector of claim 1, wherein the sleeve has a wall thickness that is thinner in an area containing the recess than in portion of the sleeve joining the recess.

10. A tubular connector comprising:

a first tubular member having an axis and an end portion with grooves formed on an outer diameter of the end portion;

a second tubular member having an end portion with a plurality of outwardly biased box end fingers separated by slots, grooves formed on an inner surface of the box end fingers, and an arcuate surface on an outer surface of the box end fingers, the second tubular member being coaxial with the first tubular member;

the arcuate surface having first and second edges axially spaced apart, and a radius of curvature extending between the first and second edges, the radius of curvature having a center point inward from the arcuate surface;

a depth of the second tubular member grooves increases as the grooves approach the second tubular member end portion;

a depth of the first tubular member grooves decreases as the grooves approach the first tubular member end portion;

wherein the grooves of the first tubular member are proximate to the grooves of the second tubular member when the first tubular member is inserted into the end of the second tubular member in an initial position;

an outer sleeve disposed around the box end fingers and having a cylindrical inner surface and an annular inner recess joining the cylindrical inner surface and tapering outwardly from the cylindrical inner surface;

an unlocking ring interposed between the first tubular member and the outer sleeve; and wherein axial movement of the outer sleeve relative to the box end fingers causes the inner recess of the outer sleeve to slide against the arcuate surface of the box end fingers, causing the box end fingers to contract radially into engagement with the grooves on the end portion of the second tubular member, thereby securing the first tubular member to the second tubular member in a made-up position.

11. The tubular connector of claim 10, further comprising:

the unlocking ring having a first end residing within an inner diameter groove of the outer sleeve;

wherein the unlocking ring has a protrusion extending from a bottom of the unlocking ring on a second end opposite the first end;

axial movement of the outer sleeve in a first direction to move the box end fingers from the initial to the made-up position moves the unlocking ring axially upwards; and axial movement of the outer sleeve in a second direction to move the box end fingers from the made-up to the initial position moves the unlocking ring axially downwards, interposing the protrusion between the grooves of the first and second tubular members to separate the first and second tubular members.

12. The tubular connector of claim 10, further comprising:

a first seal between the end portion of the first tubular member and the outer sleeve and a second seal between the end portion of the second tubular member and the outer sleeve; and wherein the box end fingers are located axially between the first and the second seals.

13. The tubular connector of claim 10, wherein the sleeve has a wall thickness that is thinner in an area containing the inner recess than in portions of the sleeve joining the inner recess.

14. The tubular connector of claim 10, wherein an outer recess is formed in the outer surface of the box end fingers that separates the arcuate outer surface from a cylindrical outer surface of the end portion of the second tubular member.

15. A method for joining tubular members comprising the steps of:

(a) providing a first tubular member having a pin end with grooves on an external surface thereof;

(b) providing a second tubular member having a box end with outwardly biased fingers, with free ends having grooves on internal surfaces thereof, the free ends having convex outer surfaces;

(c) providing a sleeve axially movable between an unlocked and a locked position, the sleeve having an inner surface with a tapered annular recess formed therein and in engagement with the outer surfaces of the box end fingers;

wherein in the locked position the sleeve is moved away from the first tubular member so that the recess of the sleeve allows the box end of the second tubular member to expand outwardly until the grooves on the box end fingers separate from the grooves on the pin end; and wherein in the locked position the sleeve is moved toward the first tubular member so that the recess of the sleeve interacts with the convex outer surfaces of the box end fingers to move the grooves of the box end fingers into engagement with the grooves of the pin end;

(d) inserting the pin end of the first member into the box end of the second tubular member;

(e) moving the sleeve for the unlocked to the locked position; and (f) providing an unlocking ring interposed between the first tubular member and the outer sleeve, the unlocking ring having a protrusion positioned for interposition between the pin end of the first tubular member and the box end fingers of the second tubular member.

16. The method of claim 15, wherein step (c) further comprises placing a nose seal on an internal shoulder of the second tubular member so that the nose seal seals to a nose on the first tubular member after the first tubular member is inserted into the second tubular member and the box end fingers engage the pin end in a made-up position.

17. A tubular connector comprising:

a first tubular member having an axis and an end portion with grooves formed on an outer diameter of the end portion, and a nose section extending past the grooves;

a second tubular member having an end portion with a plurality of box end fingers separated by slots and joined together at a base of the second tubular member, the box end fingers having free ends opposite the base with grooves formed on an inner surface of the box end fingers, the box end fingers having an outward rounded outer surface located outward from the grooves on the box end fingers, the box end fingers having a conical recess extending between the base and the outward rounded outer surface, the second tubular member being coaxial with the first tubular member;

wherein the grooves of the first tubular member are proximate to the grooves of the second tubular member when the first tubular member is inserted into the end of the second tubular member in an initial position;

an outer sleeve disposed around the box end fingers and having a cylindrical inner surface that joins an inner recess that tapers outwardly form the cylindrical inner surface;

an unlocking ring interposed between the first tubular member and the outer sleeve; and wherein axial movement of the outer sleeve relative to the box end fingers causes the inner recess of the outer sleeve to slide against the rounded outer surface of the box end fingers, causing the box end fingers to contract radially into engagement with the threads on the end portion of the second tubular member, thereby securing the first tubular member to the second tubular member in a made-up position.

18. The tubular connector of claim 17, wherein:

a depth of the second tubular member grooves increases in a direction toward the free ends of the box end fingers; and a depth of the first tubular member grooves decreases in a direction toward the nose section of the first tubular member.

19. The tubular connector of claim 17, further comprising:

the unlocking ring being secured to the outer sleeve for movement therewith;

wherein the unlocking ring has a protrusion extending from a bottom of the unlocking ring;

wherein axial movement of the outer sleeve in a first direction to move the box end fingers from the initial to the made-up position moves the unlocking ring in the first direction; and wherein axial movement of the outer sleeve in a second direction to move the box end fingers from the made-up to the initial position moves the unlocking ring in the second direction, interposing the protrusion between the grooves of the first and second tubular members to separate the first and second tubular members.

20. The tubular connector of claim 17, further comprising:

it first seal between the end portion of the first tubular member of the outer sleeve;

a second seal between the base of the second tubular member and the outer sleeve; and wherein the box end fingers are positioned axially between the first and second seals.

21. The tubular connector of claim 20, further comprising:

a cylindrical seal surface located within the outer sleeve and joining the inner recess on an edge opposite the cylindrical inner surface of the outer sleeve; and a seal on the first tubular member that engages the cylindrical seal surface.

22. The tubular connector of claim 17, further comprising a nose seal interposed between the nose section of the first tubular member and an internal shoulder in the end portion of the second tubular member.

* * * * *